US006119298A

United States Patent [19]

Kenmochi

[11] Patent Number: 6,119,298

[45] Date of Patent: Sep. 19, 2000

[54] DISPOSABLE WIPING SHEET

[75] Inventor: Yasuhiko Kenmochi, Kagawa-ken, Japan

[73] Assignee: Uni-Charm Corporation, Ehime-ken, Japan

[21] Appl. No.: 09/228,618

[22] Filed: Jan. 12, 1999

[51] Int. Cl.[7] ..... A47L 13/20

[52] U.S. Cl. ..... 15/231; 15/209.1

[58] Field of Search ..... 15/208, 209.1, 15/210.1, 231, 232

[56] References Cited

FOREIGN PATENT DOCUMENTS 4-114620 4/1992 Japan .

*Primary Examiner*—Terrence R. Till
*Attorney, Agent, or Firm*—Baker & Daniels

[57] ABSTRACT

A disposable wiping sheet used with a mop-type cleaner device has a bottom surface and a top surface extending in parallel to each other and shaped in a rectangle as viewed in its plan view. The bottom surface is flat but the top surface is relatively low in a pair of side regions extending in parallel to each other with a predetermined width and relatively high in a middle region lying between these side regions.

16 Claims, 3 Drawing Sheets

DISPOSABLE WIPING SHEET

BACKGROUND OF THE INVENTION

This invention relates generally to a wiping sheet used to wipe-up dust and dirt from a surface of house floors or walls and the like.

Japanese Patent Application Disclosure (Kokai) No. Hei4-114620 discloses a mop-like cleaner device comprising a stick and a plate-like head provided at a lower end of the stick so that a bottom surface of the plate-like head may be covered with a disposable wiping sheet and dust and dirt on a house floor or the like may be wiped up by this sheet with the stick held by the user's hand. The plate-like head is rectangular as viewed in its plan view and has its bottom surface formed convexly in the direction along short sides of the plate-like head. During use of the cleaner device, dust and dirt clinging to the floor can be scratched off by vigorously rubbing the floor with the convex region of the bottom surface of the plate-like head. On the other hand, side regions extending adjacent respective long sides of the plate-like head can be spaced from the floor by appropriately operating the cleaner device and thereby relatively bulky dust and dirt can be captured between the bottom surface of the plate-like head and the floor. With the plate-like head having such convex bottom surface, it is possible to capture the bulky dust and dirt which can not be captured by the cleaner device having the plate-like head of which the bottom surface entirely comes in contact with the floor.

With the cleaner device having the sheet carrying head of which the bottom surface is flat, it seems to be impossible to obtain the capturing effect achieved by the above-cited prior art. Nevertheless, the cleaner device having the plate-like head of which the bottom surface is flat has been widely used.

SUMMARY OF THE INVENTION

To overcome such contradiction, it is an object of the invention to provide a disposable wiping sheet allowing a cleaner device, although a sheet carrying head of the cleaner device has a flat bottom, to be used as if the bottom surface of the plate-like head is convex.

According to the invention, there is provided a disposable wiping sheet made of a soft material substantially in a rectangular shape as viewed in its plan view and having a first surface and a second surface opposed to the first surface, wherein first surface is substantially flat and the second surface is relatively low in a pair of side regions each extending with a predetermined width along associated one of a pair of edges which extend in parallel to each other but relatively high in a middle region lying between the pair of side regions.

The wiping sheet according to the present invention allows the cleaner device of which the plate-like head originally has a flat bottom to function similarly to a cleaner device having a convex bottom.

Other and further objects, features and advantages of the invention will appear more fully from the following description.

DESCRIPTION OF THE PREFERRED EMBODIMENT

Details of a disposable wiping sheet according to the invention will be more fully understood from the description given hereunder with reference to the accompanying drawings.

Figure 1:
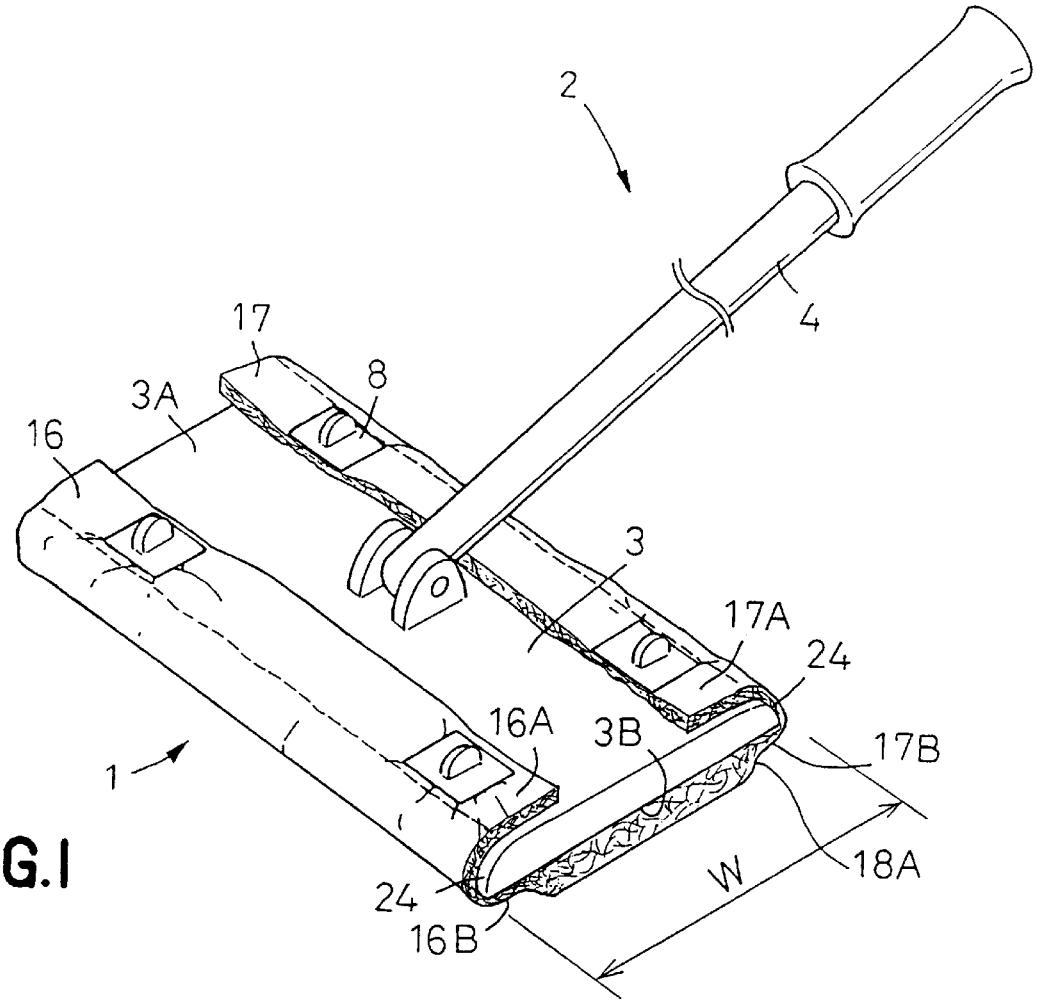
FIG. 1 is a perspective view showing a cleaner device equipped with a wiping sheet according to the invention.

FIG. 1 is a perspective view showing a cleaner device 2 equipped with a disposable wiping sheet 1. The cleaner device 2 comprises a rectangular plate-like head 3 and a stick 4. The wiping sheet 1 is shown as put in contact with a bottom surface 3B of the plate-like head 3 with its side regions 16, 17 extending along a pair of long edges and partially folded onto a top surface 3A of the plate-like head 3 to be fastened thereto by respective pairs of clips 8. After the respective components have been assembled as shown, the cleaner device 2 may be operated with the stick 4 held by the user's hand so as to wipe a house floor or the like with the wiping sheet 1.

Figure 2:
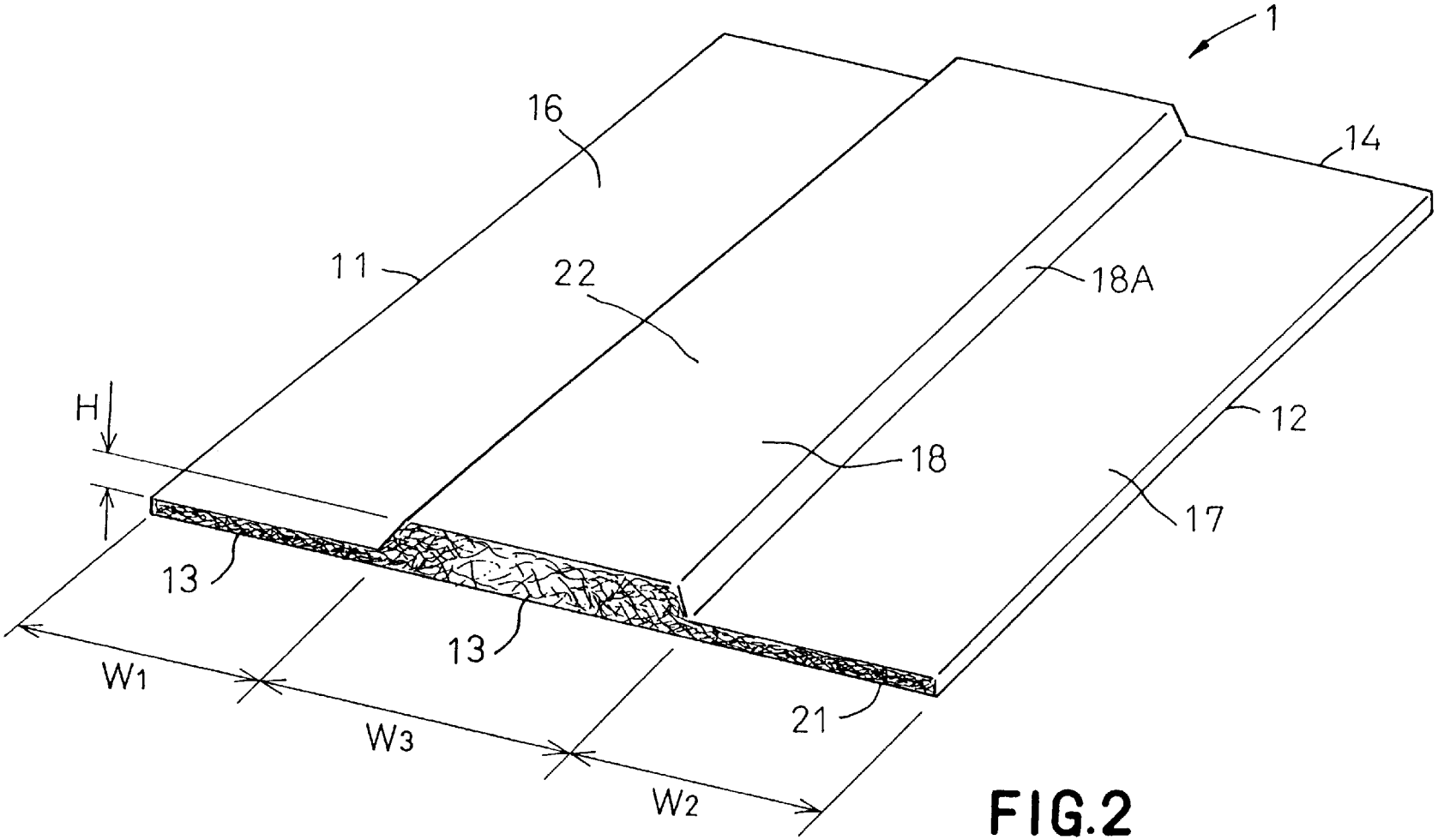
FIG. 2 is a perspective view showing the wiping sheet.
Figure 3:
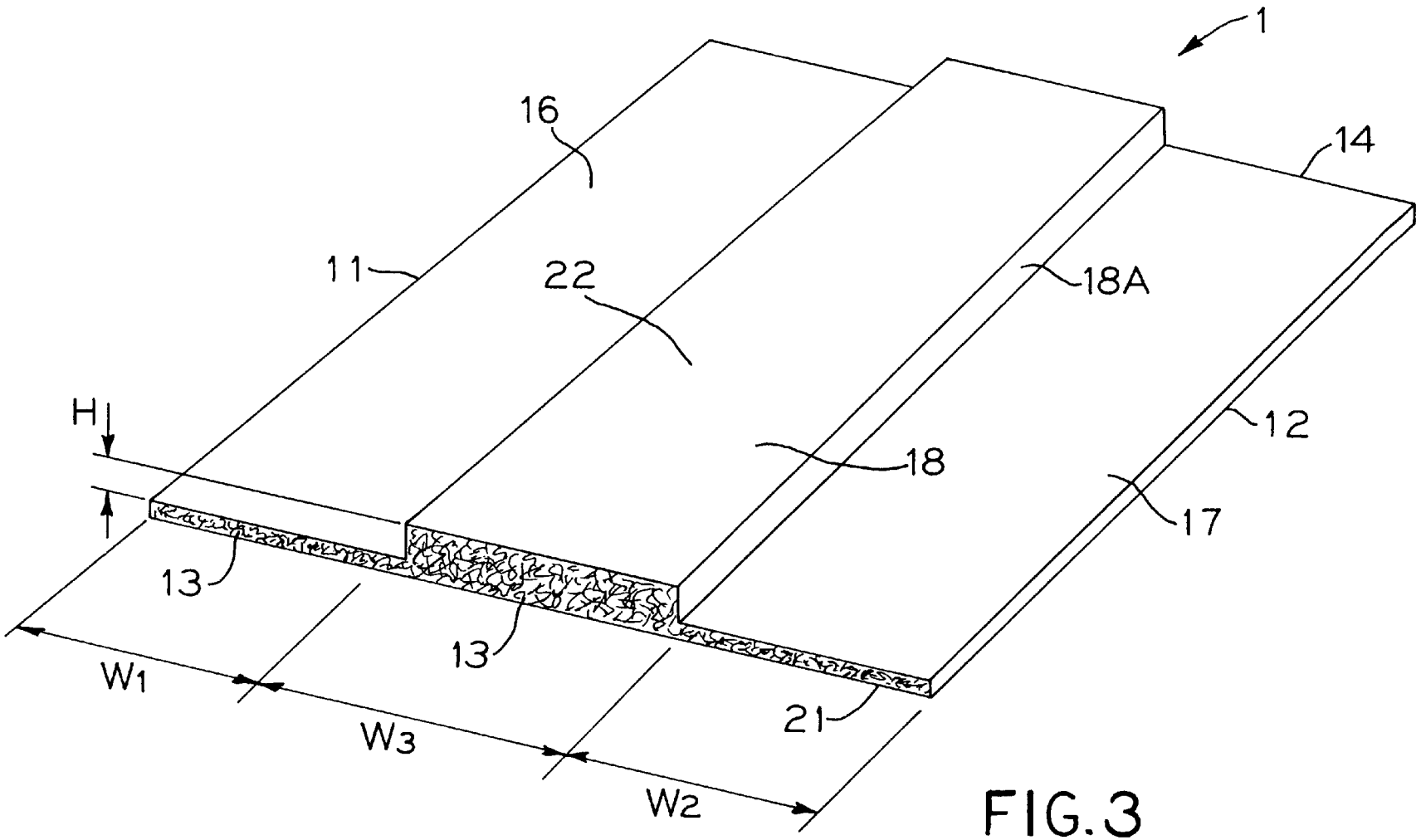
FIG. 3 is another perspective view showing a wiping sheet of rectangular cross-section.

FIG. 2 is a perspective view showing the wiping sheet 1 upside down with respect to FIG. 1. The wiping sheet 1 presents a rectangular or square shape, as viewed in its plan view, defined by two pairs of edges 11, 12 and 13, 14, each pair of edges extending in parallel to each other, and has a bottom surface 21 adapted to be put in contact with the bottom surface 3B of the plate-like head 3 and a top surface 22 adapted to face the floor. In the specific embodiment shown, the wiping-sheet 1 presents the rectangular shape defined by the one pair of edges 13, 14 together with the other pair of edges 11, 12 which are longer than the pair of edges 13, 14. The wiping sheet 1 further includes a pair of side regions 16, 17 extending along the edges 11, 12 and having widths $W_1$, $W_2$, respectively, which are thinner than a middle region 18 lying between the marginal side regions 16, 17 and extending between transversely opposite edges 13, 14 with a width $W_3$. The bottom surface 21 of the wiping sheet 1 is entirely planar. So far as the top surface 22 is concerned, the side regions 16, 17 are relatively low or thin and the middle region 18 is relatively high or thick.

Mounted on the plate-like head 3 as shown by FIG. 1, the wiping sheet 1 has sub-regions 16A, 17A at which the side regions 16, 17 are partially folded onto the top surface 3A of the plate-like head 3 and sub-regions 16B, 17B at which the side regions 16, 17 are put in contact with the bottom surface 3B of the plate-like head 3 in the proximity of opposite side edges 24 of the plate-like head 3. The sub-regions 16A, 17A are dimensioned so as to be effectively fastened by the respective clips 8. The sub-regions 16B, 17B are preferably dimensioned and configured so that one-tenth (1/10) to three-tenths (3/10) of an entire width W of the bottom surface 3B of the plate-like head 3 is occupied by these sub-regions 16B, 17B and the remaining width thereof is occupied by the width $W_3$ of the middle region 18. When the cleaner device 2 is for home use, the width $W_3$ of the middle region 18 is preferably 80~40 mm and a height H of this middle region 18 as measured from the side regions 16, 17 is preferably 3~20 mm, and more preferably 5~10 mm.

Such wiping sheet 1 may be obtained, for example, by partially heating a nonwoven fabric of thermoplastic synthetic fibers having a thickness of 3~25 mm under a pressure so as to form the side regions 16, 17. These side regions 16, 17 obtained in this manner present a density higher than that of the middle region 18 and advantageously contribute to prevent individual fibers from coming loose, thereby to prevent the wiping sheet 1 from being deformed and, in addition, allow the wiping sheet 1 to be reliably fastened by the clips 8 to the plate-like head. A nonwoven fabric comprising crimped composite fibers may be employed to obtain the bulky and elastic middle region 18. The side regions 16, 17 as well as the middle region 18 may be immersed with desired oily cleaner to facilitate dust and dirt to be captured.

When the floor is cleaned by the cleaner device 2 equipped with the wiping sheet 1 as shown by FIG. 1, the top surface 22 of the middle region 18 is put in contact with the floor and thereby dust and dirt sufficiently fine to enter between the top surface 22 and the floor are captured by the middle region 18. Dust and dirt too bulky to enter under the middle region 18 tend to gather together under the sub-regions 16B, 17B of the wiping sheet 1 and to cling to the sub-regions 16B, 17B as well as to a side wall 18A of the middle region 18. Otherwise, these bulky dust and dirt may be held by the sub-regions 16B, 17B as well as the side wall 18A so as not to be dispersed or scattered and collected at a spot on the floor. Having an appropriate stiffness, it is possible for the middle region 18 to scratch dirt off from the floor. The middle region 18 may be constructed so as to have a rectangular or trapezoidal cross-section to improve its scratching effect.

The wiping sheet 1 may be made also by bonding a piece of fibrous assembly adapted to form the middle region 18 such as a nonwoven fabric or felt to one surface of sheet material having desired characteristics, e.g., a plastic film or nonwoven fabric, by suitable means such as adhesion, heat-sealing or stitching.

The wiping sheet according to the invention is planar on its bottom surface and comprises a pair of side regions extending in parallel to each other and the middle region lying between these side regions in parallel to them, wherein the side regions are relatively thin and the middle region is relatively thick. Such configuration of the wiping sheet allows the cleaner device of which the plate-like head originally has the flat bottom to be changed to the cleaner device having a convex bottom.

Having described invention as related to the embodiment shown in the accompanying drawings, it is our intention that the invention be not limited by any of the details of description, unless otherwise specified, but rather be construed broadly within its spirit and scope as set out in the accompanying claims.

What is claimed is:

1. A disposable wiping sheet comprising:

a sheet member made from a single continuous material and having opposed parallel sides, a first surface, and a second surface opposed to said first surface, said first surface is substantially planar and said second surface is stepped between said opposed parallel sides with a pair of side regions having a first thickness and a middle region lying between said pair of side regions and having a second thickness, the thickness of the middle region being greater than the thickness of the pair of side regions.

2. The disposable wiping sheet according to claim 1, wherein said wiping sheet comprises a fibrous material having a fiber density in said pair of side regions which is higher than a fiber density in said middle region.

3. The disposable wiping sheet according to claim 1, wherein a cross-section of said middle region taken along a direction orthogonal to said opposed parallel sides is trapezoidal.

4. The disposable wiping sheet according to claim 1, wherein said wiping sheet is removably attachable to a support surface of a cleaning apparatus so that said first surface is in contact with said support surface and said second surface is exposed for wiping surfaces.

5. The disposable wiping sheet according to claim 1, wherein the sheet member is rectangular.

6. The disposable wiping sheet according to claim 1, wherein a cross-section of said middle region taken along a direction orthogonal to said opposed parallel sides is rectangular.

7. A disposable wiping sheet comprising:

a sheet member made of a nonwoven fabric and having opposed parallel sides, a first surface, and a second surface opposed to said first surface, said first surface is substantially planar and said second surface is stepped between said opposed parallel sides with a pair of side regions having a first thickness and a middle region lying between said pair of side regions and having a second thickness, the thickness of the middle region being greater than the thickness of the pair of side regions.

8. The disposable wiping sheet according to claim 7, wherein the nonwoven fabric comprises thermoplastic synthetic fibers.

9. The disposable wiping sheet according to claim 8, wherein said side regions are formed by heating the same under pressure.

10. The disposable wiping sheet according to claim 7, wherein said wiping sheet comprises a fibrous material having a fiber density in said pair of side regions which is higher than a fiber density in said middle region.

11. The disposable wiping sheet according to claim 7, wherein a cross-section of said middle region taken along a direction orthogonal to said opposed parallel sides is trapezoidal.

12. The disposable wiping sheet according to claim 7, wherein said wiping sheet is removably attachable to a support surface of a cleaning apparatus so that said first surface is in contact with said support surface and said second surface is exposed for wiping surfaces.

13. The disposable wiping sheet according to claim 7, wherein the sheet member is rectangular.

14. The disposable wiping sheet according to claim 7, wherein a cross-section of said middle region taken along a direction orthogonal to said opposed parallel sides is rectangular.

15. The disposable wiping sheet according to claim 7, wherein the nonwoven fabric comprises thermoplastic synthetic fibers.

16. The disposable wiping sheet according to claim 15, wherein said side regions are formed by heating the same under pressure.

* * * * *